US007631365B1

(12) United States Patent
Mahan

(10) Patent No.: US 7,631,365 B1
(45) Date of Patent: Dec. 15, 2009

(54) BALLISTIC ARMOR

(75) Inventor: Benjamin Mahan, Martinsville, IN (US)

(73) Assignee: Mahan Technical Design, LLC, Martinsville, IN (US)

( * ) Notice: Subject to any disclaimer, the term of this patent is extended or adjusted under 35 U.S.C. 154(b) by 489 days.

(21) Appl. No.: 11/361,966

(22) Filed: Feb. 27, 2006

Related U.S. Application Data

(60) Provisional application No. 60/774,650, filed on Feb. 21, 2006, provisional application No. 60/656,537, filed on Feb. 28, 2005.

(51) Int. Cl.
*F41H 1/04* (2006.01)

(52) U.S. Cl. ..... 2/6.7; 2/6.6

(58) Field of Classification Search ..... 2/455, 2/410, 6.5, 6.7, 424, 10, 429, 9
See application file for complete search history.

(56) References Cited

U.S. PATENT DOCUMENTS

| | | | | |
|---|---|---|---|---|
| 4,021,858 | A | 5/1977 | Neeld | |
| 4,042,974 | A * | 8/1977 | Morgan et al. | 2/9 |
| D246,012 | S | 10/1977 | Minette | |
| 4,466,138 | A | 8/1984 | Gessalin | |
| 4,475,248 | A | 10/1984 | L'Abbe et al. | |
| D277,520 | S | 2/1985 | Gregory | |
| 4,555,815 | A * | 12/1985 | Walther | 2/424 |
| 4,653,124 | A * | 3/1987 | McNeal et al. | 2/427 |
| 4,734,940 | A | 4/1988 | Galet | |
| 4,736,466 | A | 4/1988 | Kallstrom | |
| 5,129,108 | A | 7/1992 | Copeland | |
| 5,254,383 | A * | 10/1993 | Harpell et al. | 428/68 |
| 5,412,814 | A * | 5/1995 | Pernicka et al. | 2/424 |
| 5,483,699 | A | 1/1996 | Pernicka et al. | |
| 5,502,843 | A | 4/1996 | Strickland | |
| 5,555,569 | A | 9/1996 | Lane | |
| 5,603,117 | A | 2/1997 | Hudner | |
| 5,832,541 | A * | 11/1998 | Rock | 2/424 |
| 5,857,215 | A | 1/1999 | Fergason et al. | |
| D407,858 | S | 4/1999 | Cyr et al. | |
| 5,953,761 | A | 9/1999 | Jurga et al. | |
| 6,295,653 | B1 | 10/2001 | Puleo | |
| 6,338,165 | B1 | 6/2002 | Biondich | |
| 6,442,767 | B1 | 9/2002 | Meckes et al. | |
| 6,478,025 | B1 | 11/2002 | Yort et al. | |
| 6,584,614 | B2 * | 7/2003 | Hogg | 2/10 |

(Continued)

FOREIGN PATENT DOCUMENTS

| | | |
|---|---|---|
| GB | 512106 | 8/1939 |
| GB | 2046581 | 11/1980 |

OTHER PUBLICATIONS

"Bullet Proof Helmet—Combat Helmet, Tactical Helmet", website: http://www.blackarmor.com/Vest/Helmet.htm, 2 pages, printed from the Internet on Jun. 22, 2006.

(Continued)

*Primary Examiner*—Shaun R Hurley
*Assistant Examiner*—Andrew W Sutton
(74) *Attorney, Agent, or Firm*—TDW Patents & Consulting; Thomas D. Webster

(57) ABSTRACT

A ballistic face guard (100) for providing additional protection to a wearer's face and neck. A ballistic face guard (100) in combination with a ballistic visor (1000) for providing additional protection to a wearer's face, neck, and eyes. A ballistic face guard (100) in combination with a ballistic visor (1000) and a military helmet (140) for providing protection to a wearer's face, neck, eyes and head.

3 Claims, 12 Drawing Sheets

U.S. PATENT DOCUMENTS

| | | | | |
|---|---|---|---|---|
| 6,694,531 | B2 | 2/2004 | Arai | |
| 6,795,977 | B2 | 9/2004 | Basson et al. | |
| 6,804,829 | B2 * | 10/2004 | Crye et al. | 2/6.6 |
| 6,892,400 | B1 * | 5/2005 | Choi et al. | 2/424 |
| 7,260,850 | B2 * | 8/2007 | Ambuske et al. | 2/6.3 |
| 2002/0174480 | A1 | 11/2002 | Lombard | |
| 2003/0033657 | A1 | 2/2003 | Austin | |
| 2004/0049825 | A1 | 3/2004 | DeHaan | |
| 2004/0221375 | A1 | 11/2004 | Douglas | |
| 2005/0015855 | A1 | 1/2005 | Skiba | |

OTHER PUBLICATIONS

"Helmet Face Shield", website: http://www.rangerjoes.com/product_info.php?products_id=273, 2 pages, printed from the Internet on Feb. 4, 2005.

"Helmet Face Shield for ACH/MICH and PASGT Helmets", website: "Ranger Joe's International", website: http://www.rangerjoes.com/helmet-face-shield-for-achmich-and-pasgt-helmets-p-2931.html, 2 pages, printed from the Internet on Jun. 22, 2006.

"IMS-Plus Military Helmets", website: http://www.imsplus.com/ims37.html, 8 pages, printed from the Internet on Feb. 4, 2005.

"Military and Police Face Shields", website: "Helmet Face Shield", website: http://www.securityprousa.com/goeyemash.html, 2 pages, printed from the Internet on Feb. 4, 2005.

"Military Helmets and Accessories", website: http://www.imsplus.com/ims37.html, 10 pages, printed from the Internet on Jun. 22, 2006.

"Mounting face shield system", website: http://www.securityprousa.com/mofashsy.html, 2 pages, printed from the Internet on Jun. 22, 2006.

* cited by examiner

BALLISTIC ARMOR

CROSS-REFERENCE TO RELATED APPLICATIONS

This application claims the benefit of U.S. Provisional Patent Application Ser. No. 60/656,537, filed Feb. 28, 2005, and U.S. Provisional Patent Application Ser. No. 60/774,650 filed Feb. 21, 2006. The entire contents of both provisional applications are incorporated herein by reference.

FIELD OF THE INVENTION

This invention relates generally to ballistic armor. More specifically, the invention is a ballistic resistant face guard and a ballistic visor according to the invention.

BACKGROUND OF THE INVENTION

There is an overwhelming desire among the general population to protect combat soldiers as far as reasonably possible. Body armor has a significant role to play in protecting soldiers from bullets and shrapnel injuries. Likewise, helmets worn by soldiers help to reduce head injuries. While body armor and helmets reduce injuries to combat soldiers, such items offer very little facial protection against, for example, shrapnel, bullets, and impact injuries of the type that occur in vehicle accidents. Improvised explosive devices (IEDs) are often packed with ball bearings or nails designed to maim and disfigure victims. Thus, there is a need for an armored face guard that works cooperatively with a helmet to help protect a soldier's face from bullets and shrapnel.

U.S. Pat. No. 6,804,829, issued Oct. 19, 2004 to Crye et al., describes a military or police helmet system. The '829 helmet system includes a flexible plastic liner mounted to the wearer's head by a strap assembly. A ballistic shell with a shallow front wall is fastened to the liner and an eye shield assembly is pivotally mounted to the liner for movement between a deployed position and a retracted position between the shell and the liner. The liner has a rear segment connected to a cap segment, with cutout slots which allow the liner to apply pressure to the wearer's neck. A chinstrap is slidable on two stiff side straps, which have curved segments allowing the chinstrap to move with the user's jaw. A protective face guard assembly engages with the liner and has openings covered by resilient sheets, which permit a marksman feel a rifle stock through the face guard.

U.S. Patent Publication No. 2002-0174480 A1, published Nov. 28, 2002 to Lombard, describes a sports helmet. The Lombard helmet includes relatively wide and deep lateral reliefs in the helmet for improved peripheral vision for a person wearing the helmet, while a face guard is formed with a series of closely spaced lateral bars there across for precluding insertion of the fingers or hand therein. The present helmet and face guard are particularly well suited for use in the game of football, but may be adapted for use in other contact sports as well. The present helmet greatly improves safety by providing a wider field of view for a player using the helmet, and the present face guard greatly reduces the opportunity for opposing players to use the face guard for restraining or tackling players, thereby greatly reducing injuries and increasing safety during play.

U.S. Pat. No. 5,857,215, issued Jan. 12, 1999 to Fergason et al., describes a welding helmet having high structural integrity is formed of a single sheet of composite material, such as Kevlar fabric impregnated with a phenolic thermoset resin; a viewing port in the front of the helmet includes a welding lens is either of fixed or automatically darkening type; and curves, bends, folds and steps in the composite material and trim pieces in the viewing port area and about the peripheral rim of the helmet shell provide additional stiffening for the helmet. A method of making a welding helmet of a single sheet of composite material includes pre-forming the composite material to a shape similar to that of the finished molding helmet shape, and placing the pre-shaped composite material in a compression mold and closing the mold to mold the composite material to shape while curing the composite material by applying heat other otherwise assisting in the curing of the composite material; and mounting a welding lens in a viewing port of the welding helmet.

U.S. Pat. No. 6,026,510, issued Feb. 22, 2000 to Kocher, describes a "bullet deflection, fighting position body armor". The '510 patent describes a bullet defeat mechanism approach which is said to be different than conventional armor's objective of stopping bullets. The '510 patent describes a method that relies on providing concave and convex channels to a ballistic plate for protecting a person in the line of fire.

None of the above inventions and patents, taken either singly or in combination, is seen to describe the instant invention as claimed.

SUMMARY OF THE INVENTION

A ballistic face guard (100) for providing additional protection to a wearer's face and neck. A ballistic face guard (100) in combination with a ballistic visor (1000) for providing additional protection to a wearer's face, neck, and eyes. A ballistic face guard (100) in combination with a ballistic visor (1000) and a military helmet (140) for providing protection to a wearer's face, neck, eyes and head.

DETAILED DESCRIPTION OF THE INVENTION

Figure 1:
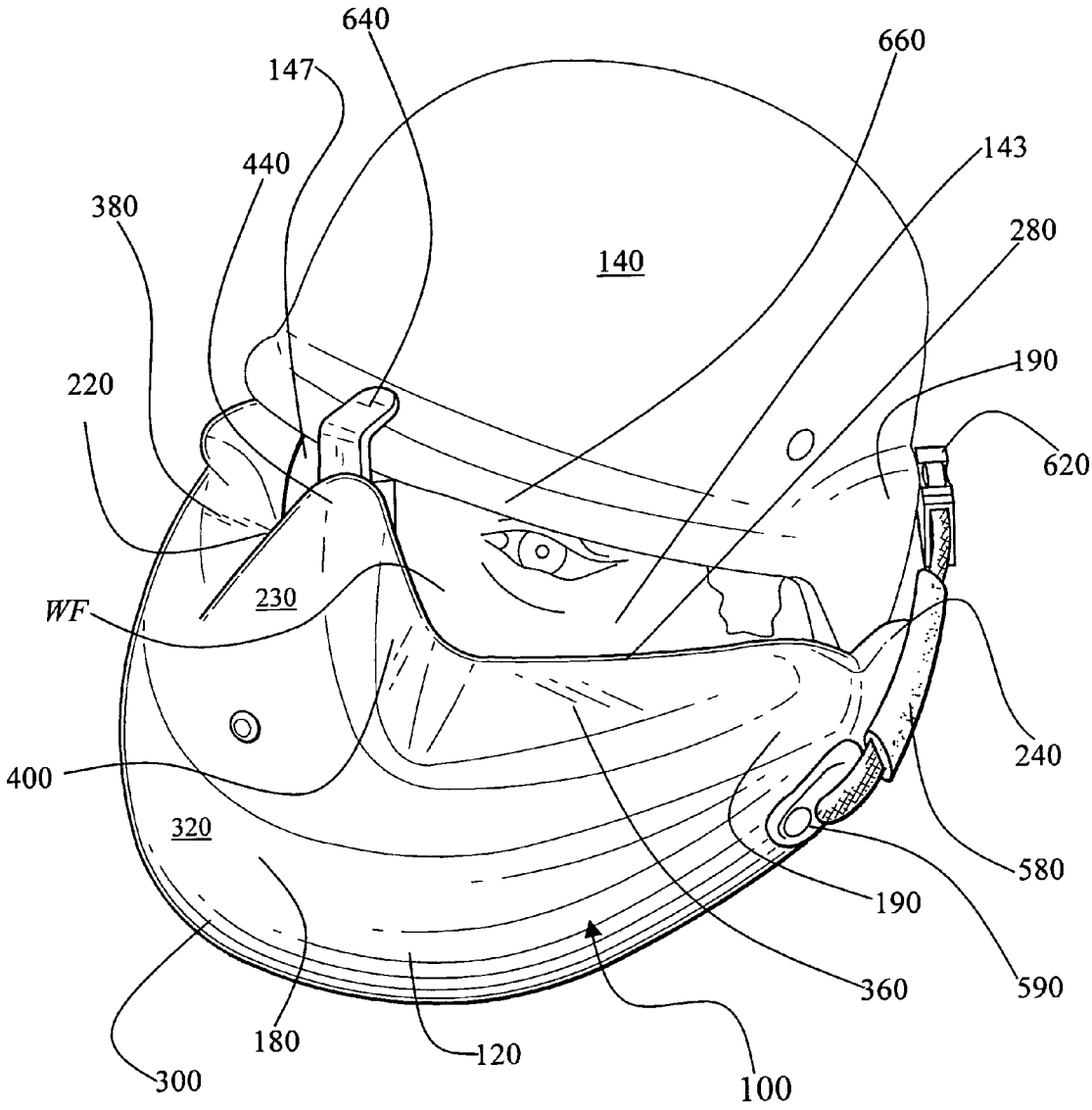
FIG. 1 shows a partial environmental perspective view of a ballistic face guard fitted to a soldier's helmet according to the present invention.
Figure 2A:
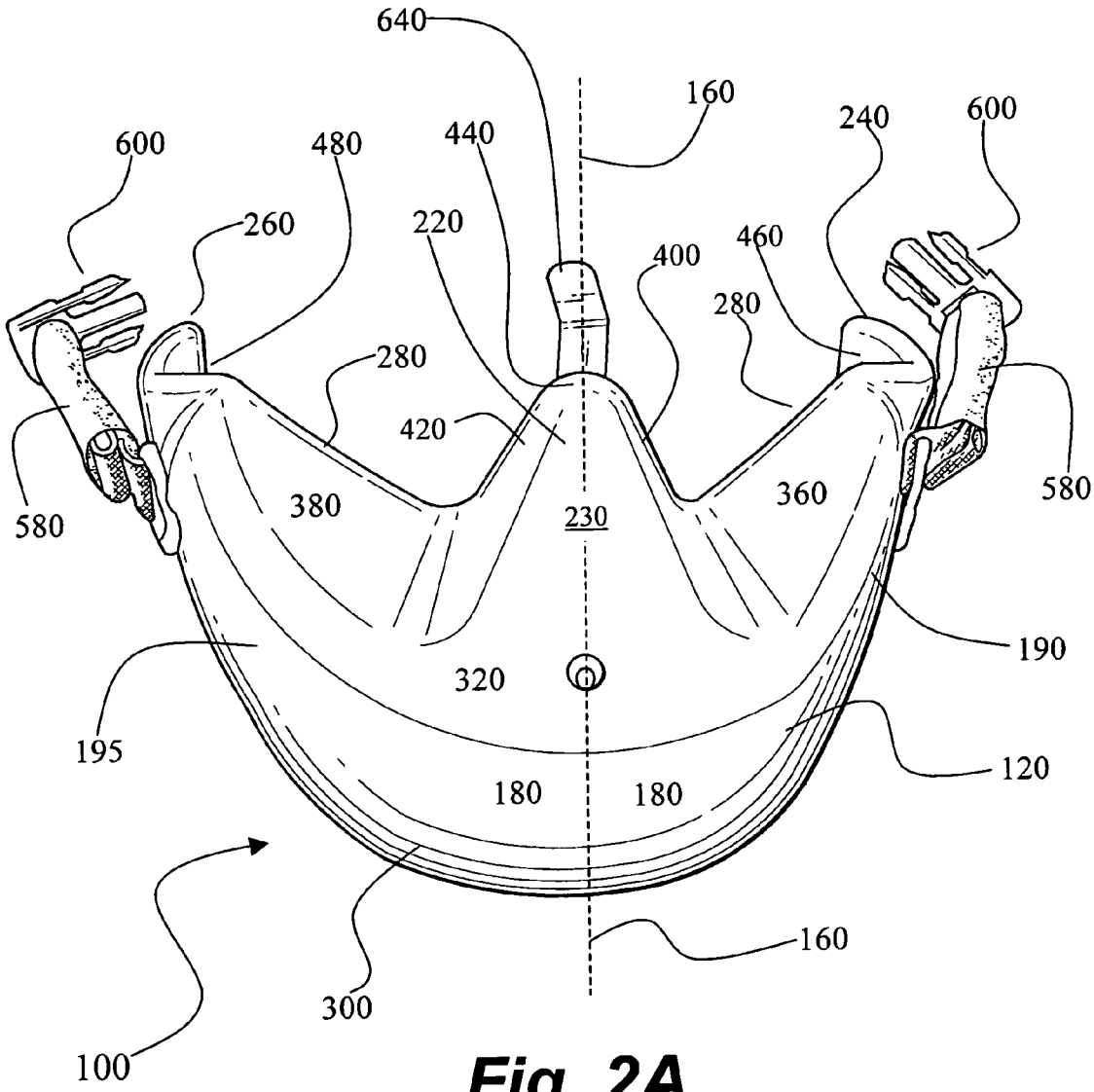
FIG. 2A shows a front perspective view of a ballistic face guard according to the invention.
Figure 2B:
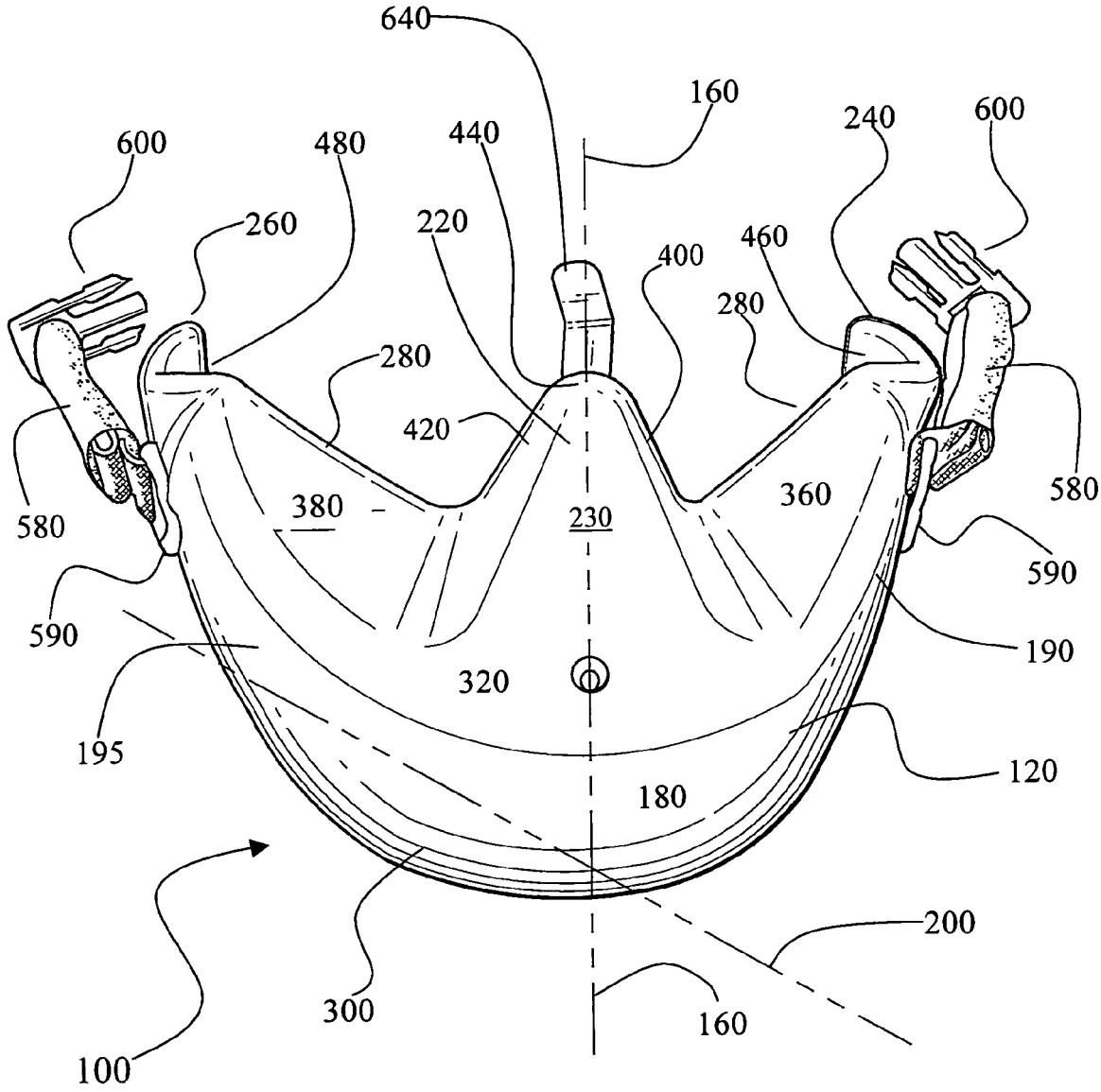
FIG. 2B shows a front perspective view of a ballistic face guard according to the invention.

This invention relates generally to ballistic armor. More specifically, the invention is directed to a ballistic resistant face guard and a ballistic visor according to the invention. The ballistic face guard of the invention is denoted generally by the numeric label "100", and the ballistic visor of the invention is denoted generally by the numeric label "1000".

The armored face guard 100 is designed to provide protection to the wearer's face from various threats, such as impact, fragmentation, small arms fire, or natural elements. Further, the armored face guard 100, which comprises a ballistic frame member 120, in normal use is attached to a standard helmet 140 (such as, but not limited to, a standard U.S. Marine combat soldier's helmet). The ballistic frame member 120 is lightweight as possible to reduce fatigue on the wearer's head, and to counter balance the helmet 140 as it rests on the wearer's head. It should be understood that the terms "person" and "wearer" are regarded herein as equivalent terms with the single exception of "a person of ordinary skill". For example, the terms "wearer's nose" and "person's nose" are regarded herein as equivalent terms.

The armored face guard 100, and more particularly the ballistic frame member 120, can be constructed of various materials and orientations that will protect against shrapnel, small arms fire, spall, and various other high velocity projectiles. In addition, the armored face guard 100 provides protection against non-combat related injuries, such as those found in vehicle collisions, riot thrown debris, natural elements, convoy related airborne debris, etc. The armored face guard 100 will ultimately increase the combat effectiveness of the individual soldier/marine by significantly reducing the amount of facial trauma normally encountered in the typical combat environment.

The armored face guard 100 is designed to be attachable to existing combat helmets, without significant modifications to helmet design. The armored face guard 100 is designed for fast attachment and detachment to/from a helmet such as a standard issue U.S. Marine helmet. The face guard 100 of the invention can be reversibly attached to a helmet in combination with a night vision device to allow, for example, a combat soldier to complete tasks in the dark while wearing the face guard 100 attached to his/her helmet. The face guard 100 is designed for easy attachment and removal, and overall simplicity, maximizing ease of use, while being compatible with combat infantry night vision ancillary devices normally encountered within the current military environment.

The armored face guard 100 is designed to reduce the amount of facial trauma by extending the ballistic coverage around the face and neck by about 90%. In principle, the armored face guard 100 works, at least in part, by transferring the energy of impacts to the attached helmet system rather than if it were attached directly to the wearer's face.

The armored face guard 100 is designed to be compatible with current communications equipment whether mounted in the helmet, or other devices such as radio handsets, etc. It is also compatible with other helmet-mounted equipment such as night vision systems, weapon sighting systems, and MOPP gear. The armored face guard 100 can include different forms of air vents or drilled holes to maximize airflow to the user, allowing for maximum comfort while still maintaining optimum ballistic protection. The armored face guard 100 could be manufactured like the current style helmets. For example, the ballistic frame member 120 may be made from woven layers of organic polymers (such as an aramid exemplified by KEVLAR®) and non-woven scrim prepreg impregnated with a heat curable resin such as, but not limited to, phenol-formaldehyde/polyvinyl butyral based resin as described in U.S. Pat. No. 5,190,802 (issued to Pilato). U.S. Pat. No. 5,190,802 (issued to Pilato) is incorporated herein by reference in its entirety. Conventional heated treatment and/or heated presses can be utilized for the bonding of the layers of woven fabric and non-woven scrim prepreg by compression molding. These methods of making ballistic armor are well known to those skilled in the art. The ballistic frame member 120 can, for example, be made from layers of resin-coated woven aramid enclosing one or more layers of substantially uncoated woven aramid in place of layers of non-woven scrim prepreg.

The armored face guard 100 could be mounted to the helmet in various forms. This could include, but is not limited to: (a) mounting brackets inserted inside the helmet, (b) the armored face guard 100 can be molded to fit to some aspect or shape of the helmet 140, then fastened by some form of buckles or straps, or (c) mounting brackets attached by using the current holes drilled for the helmets existing suspension system, etc.

Various forms of goggles or visors (described in more detail below) could be implemented with the armored face guard 100 to further reduce the amount of trauma to the eyes and face, by forming a seal with the armored face guard 100 to keep out dust and the aforementioned ballistic threats. It could also include colored lenses for protection against threats from LASER devices, as well as sun and glare protection.

The armored face guard 100 may be molded of conventional infantry helmet material, such as layers or alternating layers of aramid such as KEVLAR® material produced by E. I. du Pont de Nemours and Company or PBO fibers, or the like. The armored face guard 100 may be formed of other high performance ballistic materials such as titanium, alumina-ceramics, and high-strength composites. The exterior surface of the armored face guard 100 may also be provided with various known slippery coatings and finishes to increase the tendency of bullets and/or fragments to deflect or skim off of the exterior surface of the armored face guard 100. For example, the armored face guard 100 can be a ballistic resistant laminate (as described, for example, in U.S. Pat. No. 5,190,802) made by bonding alternating plies of fabric woven from glass or aramid polymers (e.g., KEVLAR® layers) and non-woven scrim prepreg impregnated with a heat curable resin. The heat curable resin may be, for example, phenol-formaldehyde/polyvinyl butyral blend. Other suitable resins include carbon-graphite resin, polyester resin (thermoset), epoxy resins, phenolic resin (thermoset), silicone resin (thermoset), polyimide resin (thermoset), polysulfone resin (thermoset) and/or resins described in Chapter 4 in the U.S. Dept. of Defense Military Handbook entitled: "Plastic Matrix Composites With Continuous Fiber Reinforcement" (MIL-HDBK-754(AR)) 19 Sep., 1991 (Distribution Statement A: Approved for public release; distribution is unlimited).

Alternatively, the face guard 100 can be made out of three-dimensional ("3D") woven composite material as described by Stobbe and Mohamed ($48^{th}$ International SAMPE Symposium, May 11-15, 2003). For example, the face guard 100 can be made out of a moldable multilayer laminated woven structure incorporating at least one 3D woven material layer (described in U.S. Pat. No. 6,281,149 issued Aug. 28, 2001 to Hussein et al.) in combination with a thermoplastic material. U.S. Pat. No. 6,281,149 is incorporated herein by reference in its entirety.

In more detail and referring to FIGS. 1 through 4, which show various perspective views of the ballistic face guard 100, which comprises ballistic frame member 120. The ballistic face guard 100 is designed to attach to a standard issue military helmet or helmet system 140. The face guard 100 has two-fold symmetry about mid-point vertical axis line 160 (see FIG. 2A) that bisects ballistic frame member 120 (and by default, face guard 100, which comprises ballistic frame member 120). The ballistic frame member 120 is curved in the horizontal plane 200 in a rearward direction to fit around a wearer's face WF (see FIG. 1). The ballistic frame member 120 includes a front end 180, which in turn includes a nose section 220. The ballistic frame member 120 includes a left rear end 240, a right rear end 260, top 280, bottom 300, exterior surface 320, a semi-enclosed surface 340, at least one downward sloping ledge at some point between left and rear ends 240 and 260 such as a left downward sloping ledge 360 and a right downward sloping ledge 380 to provide the wearer with substantially unobstructed downward views. The left 360 and right 380 downward sloping ledges also serve to stiffen the face guard 100. When the ballistic face guard 100 is fitted to helmet 140, the left 360 and right 380 downward facing slopes respectively define left and right viewing areas 143 and 147 via which the wearer can view his/her environment and surroundings.

It should be understood that the left and right slopes 360 and 380 are not created by tapering or otherwise thinning the top 280 of ballistic frame member 120, but rather represent a bending in the top 280 of the ballistic frame member 120. Thus, left and right slopes 360 and 380 define complementary internal slopes 360*a* and 380*b* (see FIG. 4) such that the bottom 300 is somewhat offset with respect to the wearer's mouth (not shown). Thus, much of the semi-enclosed surface 340 is maintained at a distance away from the wearer's mouth. More specifically, the semi-enclosed surface 340 includes semi-enclosed surface 340*a* (see FIG. 4) at the front end 180 of ballistic frame member 120, which is somewhat offset from the wearer's mouth. This offset is particularly advantageous because it substantially reduces the requirement for drilling or otherwise providing ventilation holes through the front end 180 of ballistic frame member 120, which would lower the capability of the front end 180 to resist bullets and/or fragments impacting on the front end 180.

It should be understood that the terms "left" and "right" are arbitrarily chosen from the perspective of the wearer's own left and right features such as the left and right sides of their face and/or eyes, and should not be interpreted as being limiting on the present invention as claimed.

It should be understood that the left and right rear ends 240 and 260 are also referred to herein as "rear ends 240 and 260". It should be understood that the left and right ledges 360 and 380 are also referred to herein as "side ledges 360 and 380".

Still referring to FIGS. 1 through 4, the front end 180 extends upward to form a generally V-shaped nose section 220 to accommodate a wearer's nose and protect the middle of a wearer's face. The generally V-shaped nose section 220 has a front face 230, a left nose side 400 and a right nose side 420. The nose front face 230, and nose sides 400 and 420 converge together to form a curved nose apex 440. It should be understood that the left and right nose sides 400 and 420 are also referred to herein as "nose sides 400 and 420". It should be understood that while the nose section 220 is shown as a generally V-shaped structure, the nose section 220 can adopt any suitable overall shape, such as an oval shape, a generally rectangular shape, a polygonal shape, etc.

Figure 3A:
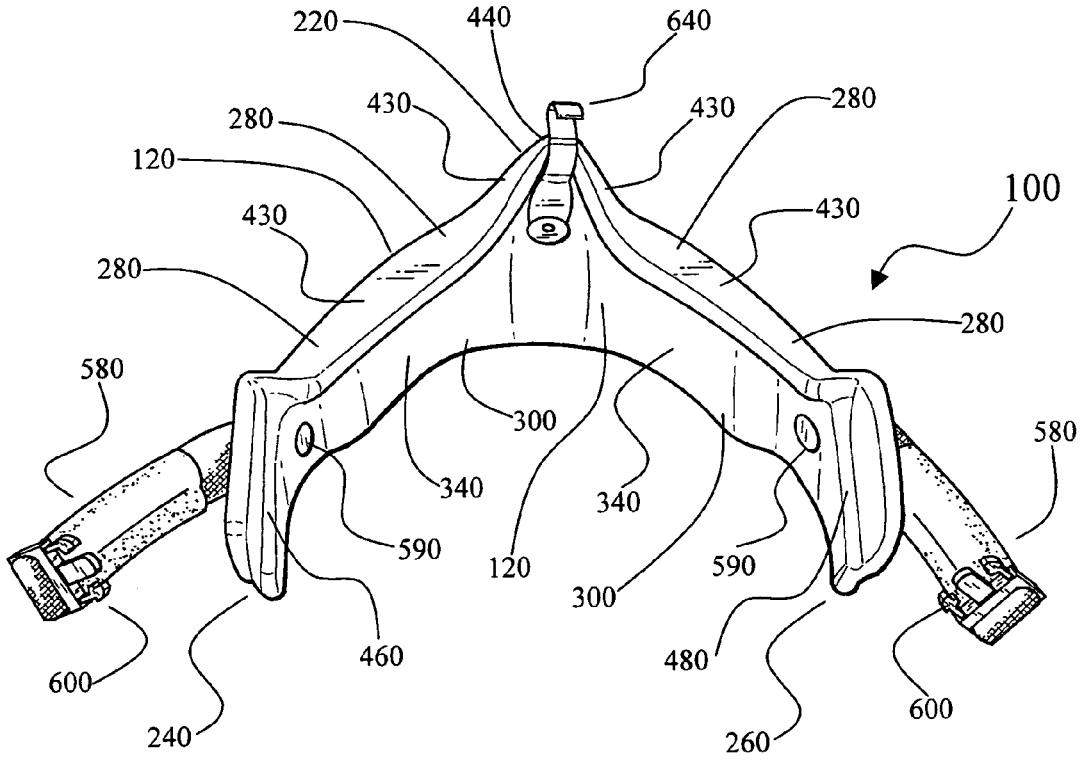
FIG. 3A shows an elevated rear perspective view of a ballistic face guard according to the invention.
Figure 3B:
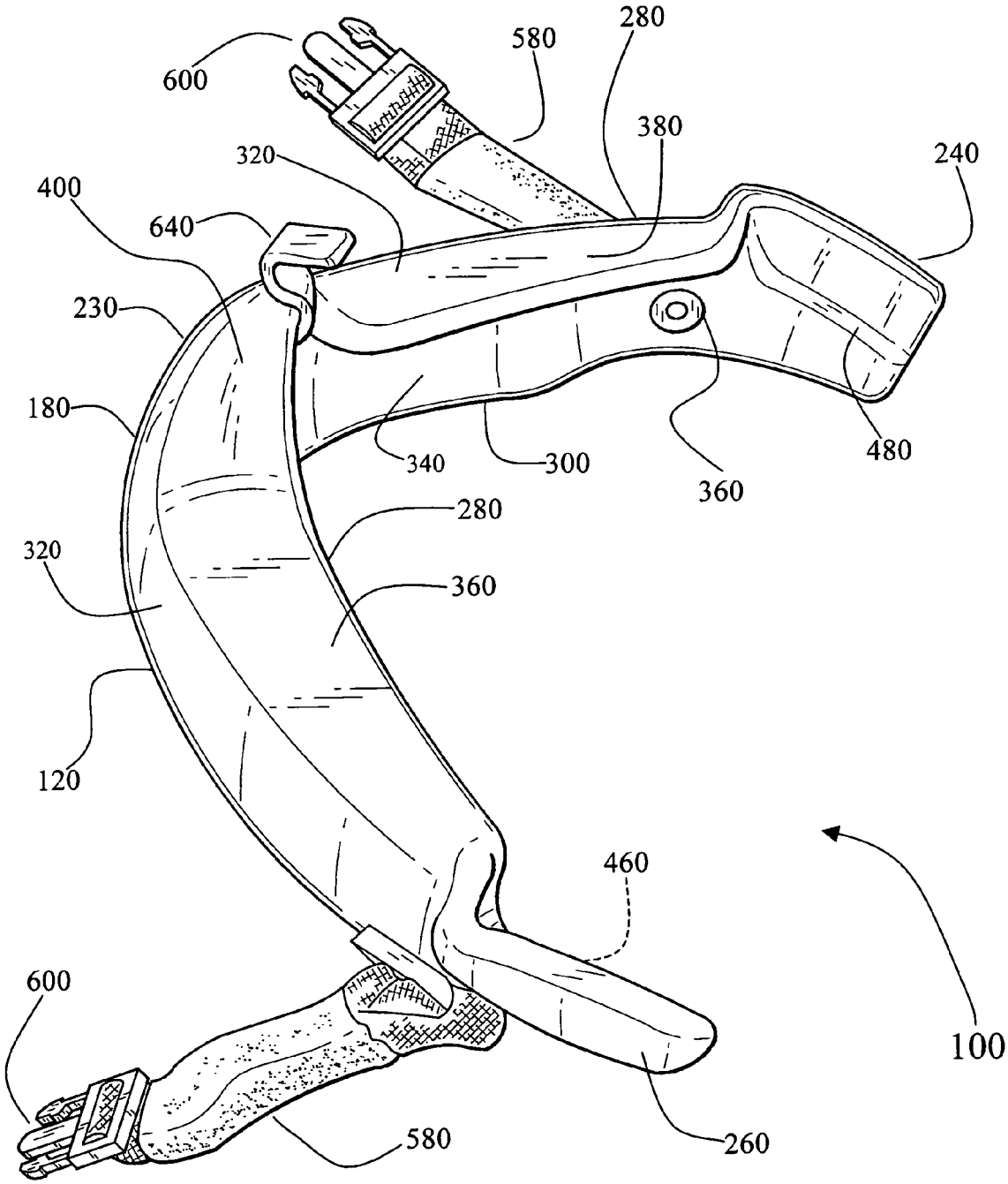
FIG. 3B shows an elevated left side perspective view of a ballistic face guard according to the invention.

It should be understood that the top 280 of ballistic frame member 120 may be molded such that ledges 360 and 380 and left and right nose sides 400 and 420 form a continuous ledge 430 as shown in FIG. 3A.

Figure 9:
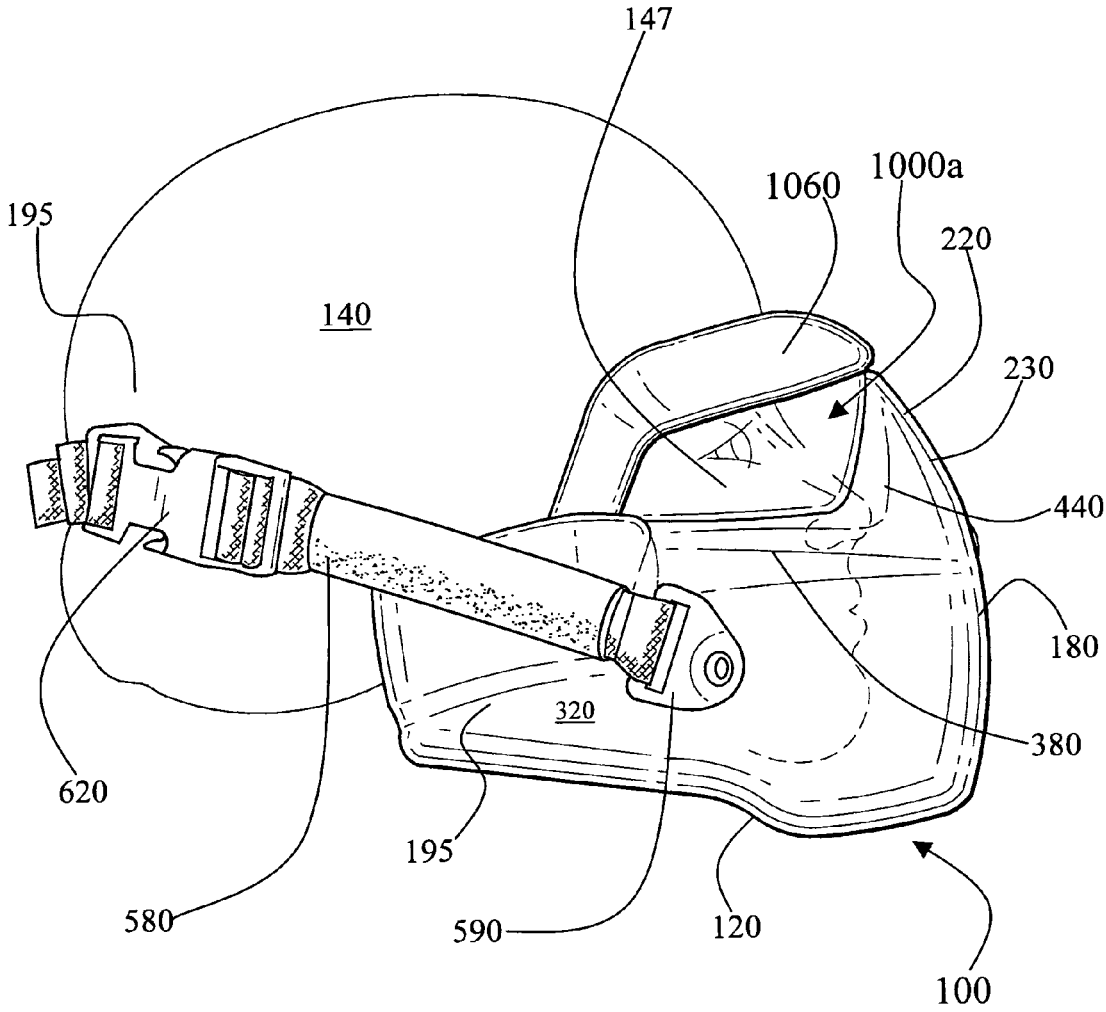
FIG. 9 shows a different embodiment of the ballistic visor according to the invention.

In FIG. 9, the front face 230 is shown having an angled-back and outwardly curved front face 230'. The outwardly curved front face 230' forms part of the exterior surface 320. It will be understood by a person of ordinary skill in the art that the front face 230' can adopt different styles such as an angled-back substantially flat surface. Alternatively, the front face 230' can extend upwards at a tangential angle. An angled-back exterior curvature 230' provides further stiffening to the face guard 100 without compromising the ability of the front end 180 to resist or deflect bullets and/or fragments. If present, the combination of a curved front face 230', the overall curved shape 200 in the horizontal plane of the face guard 100, the left and right downward facing slopes 360 and 380, and right and left nose sides 400 and 420, all combine to add stiffness to the face guard 100.

The top 280 of face guard 100 is bent inwards at least part of the way between the left rear end 240 and the left side 400 of nose section 220 to create left downward sloping edge 360. The top 280 is bent inwards at least part of the way between the right rear end 260 and the right side 420 of nose section 220 to create right downward sloping edge 380. These bends help stiffen the ballistic face guard 100 without detrimentally impacting on the ability of the ballistic face guard 100 to resist or deflect bullets and/or fragments (such as fragments generated by, for example, improvised explosive devices (IEDs) like those used currently in Iraq to maim or injure American troops).

Left and right face guard ends 240 and 260, respectively, include left and right semi-enclosed ledges 460 and 480. The left and right semi-enclosed ledges 460 and 480 are designed to accommodate the left 500 and right 520 bottom edges of helmet 140. Thus, at least some of the impact energy from bullets or fragments striking the face guard 100 are transferred to the helmet 140 via left and right ledges 460 and 480 in face guard 100. It should be understood that the left and right semi-enclosed ledges 460 and 480 are also referred to herein as "semi-enclosed ledges 460 and 480".

At least one attachment system is used to reversibly attach the face guard 100 to a helmet 140. The term "reversibly attach" simply means that the face guard 100, and more particularly the ballistic frame member 120, can be attached and released with little effort to/from the helmet 140. It will be understood by a person of ordinary skill in the art that any suitable attachment system for reversibly attaching the face guard 100 to a helmet 140 can be used.

The at least one attachment system can take the form may be, for example, a buckle system 580 such as that shown in FIG. 1. The buckle system 580 is fitted to the left 190 and right 195 sides of the face guard 100 (see, e.g., FIG. 4). The buckle system 580 is connected to the ballistic frame member 120 by means of connector 590. The buckle system 580 includes at least one plug member 600. The at least one plug member 600 is inserted into a complementary at least one female socket member 620 fitted to the left 190' and right 195' sides of helmet 140. The locations of the at least one plug member 600 and at least one socket member 620 can be reversed, for example, the at least one female socket member 620 can be attached to the left 190 and right 195 sides of face guard 100, and the at least one plug member 600 attached to the left 190' and right 195' sides of helmet 140. Alternatively, one female socket member 620 is fitted to either side 190' and 195' with a male plug 600 member attached to either side 190 and 195 of ballistic frame member 120.

The terms "female socket member 620" and "female latch member 620" are regarded as equivalent terms. The terms "male plug member 600" and "male attachment member 600" are regarded as equivalent terms. It should be understood that any type of female and male latch members can be used and are expressly not limited to female socket member 620 and male plug member 600, respectively.

The operation of a buckle system is well known and is described in detail, for example, in U.S. Pat. No. 6,786,786 (issued to Davis). The content of U.S. Pat. No. 6,786,786 (Davis) is incorporated herein by reference in its entirety.

Figure 4:
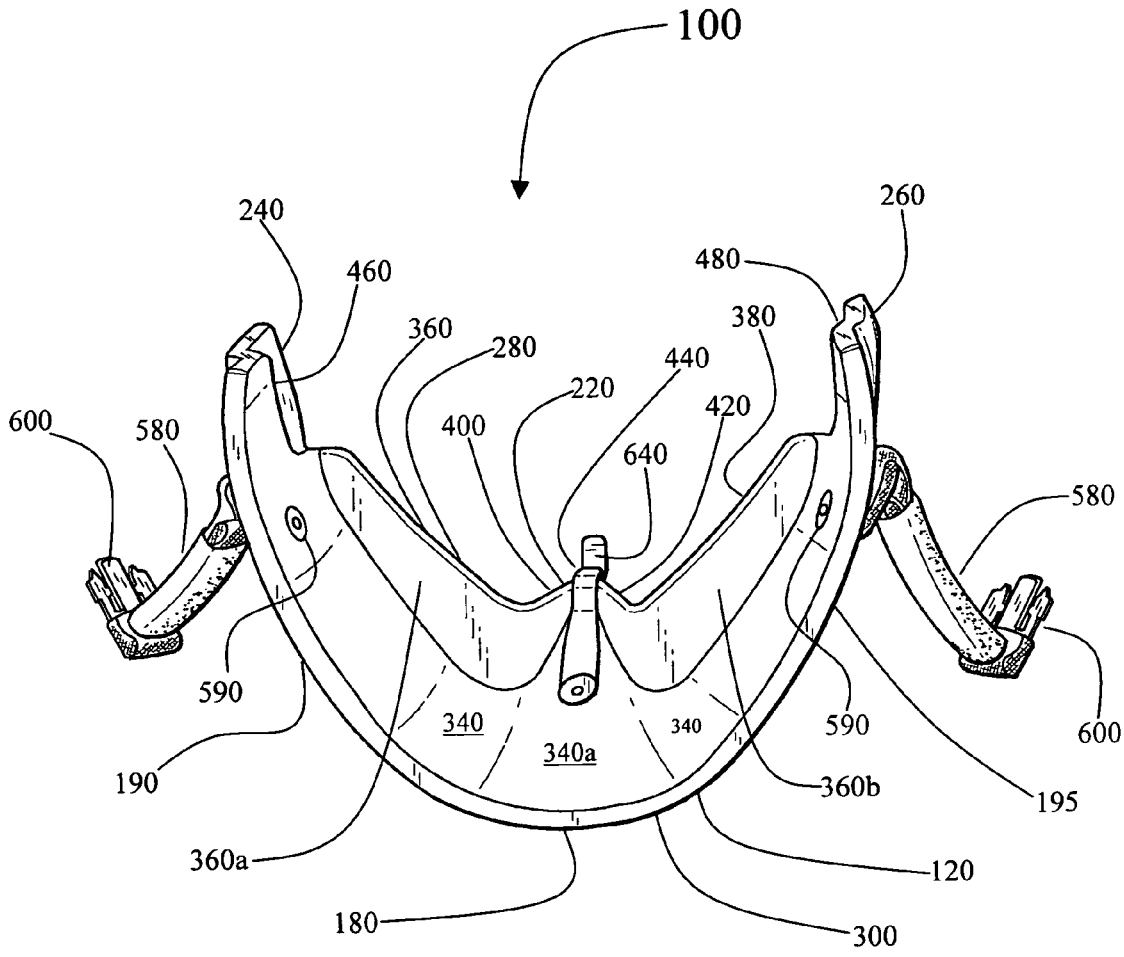
FIG. 4 shows a bottom perspective view of a ballistic face guard according to the invention.

An optional central connector 640 is shown fitted to the nose apex 440 (see, e.g., FIG. 4). The optional connector 640 is be used to attach the front end 180 of the ballistic frame member 120 to the front rim 660 of the helmet 140. Impact energy from bullets and/or fragments striking the face guard 100 is at least partially transferred to the helmet 140 via central connector 640. Since helmet 140 is likely fitted with an internal energy absorbing inner lining, impacts to the face guard 100 are positively dissipated into the helmet 140 thus reducing bruising to the wearer's face.

The optional central connector 640 also serves to hold the front end 180 of the ballistic frame member 120 slightly offset with respect to the wearer's face wf. This is particularly advantageous because the left and right slopes 360 and 380 produce an internal offset wherein there is sufficient space between the wearer's mouth and the bottom 300 to allow the wearer to breath without requiring breathing holes in the front end 180 of the ballistic frame member 120. More specifically, the optional connector 640 helps maintain an offset between the wearer's mouth and semi-enclosed surface 340*a* thereby reducing the requirement for drilling or otherwise providing ventilation holes through the front end 180 of ballistic frame member 120, which would lower the capability of the front end 180 to resist bullets and/or fragments impacting on the front end 180.

The visor 1000 can be made out of any ballistic rated material such as, but not limited to, ballistic grade polycarbonate. For example, the visor 1000 can comprise a ballistic layer of 2.5 mm thick selenite ballistic grade polycarbonate. The thickness of the ballistic layer can vary. For example, the visor 1000 can comprise a layer of 2.0 mm thick selenite ballistic grade polycarbonate. Additional layers may be added to the visor 1000, such as an interference filter layer deposited on a layer of ballistic grade polymer as described in U.S. Pat. No. 5,005,926 (issued to Spielberger). The entire content of U.S. Pat. No. 5,005,926 (issued to Spielberger) is incorporated herein by reference.

The visor 1000 might include a clear polycarbonate designed for ballistic protection while another visor 1000 may include additional dyes or additional layers for light (e.g., laser light) protection. More specifically, and as described in U.S. Pat. No. 6,923,537 (issued to Hartley et al.), dyes may be introduced into or on the polycarbonate material (in this case, into or onto the visor 1000) for ultra violet radiation protection, sun light protection, visible light protection, and infrared protection, etc. The entire content of U.S. Pat. No. 6,923,537 is incorporated herein by reference.

Figure 5:
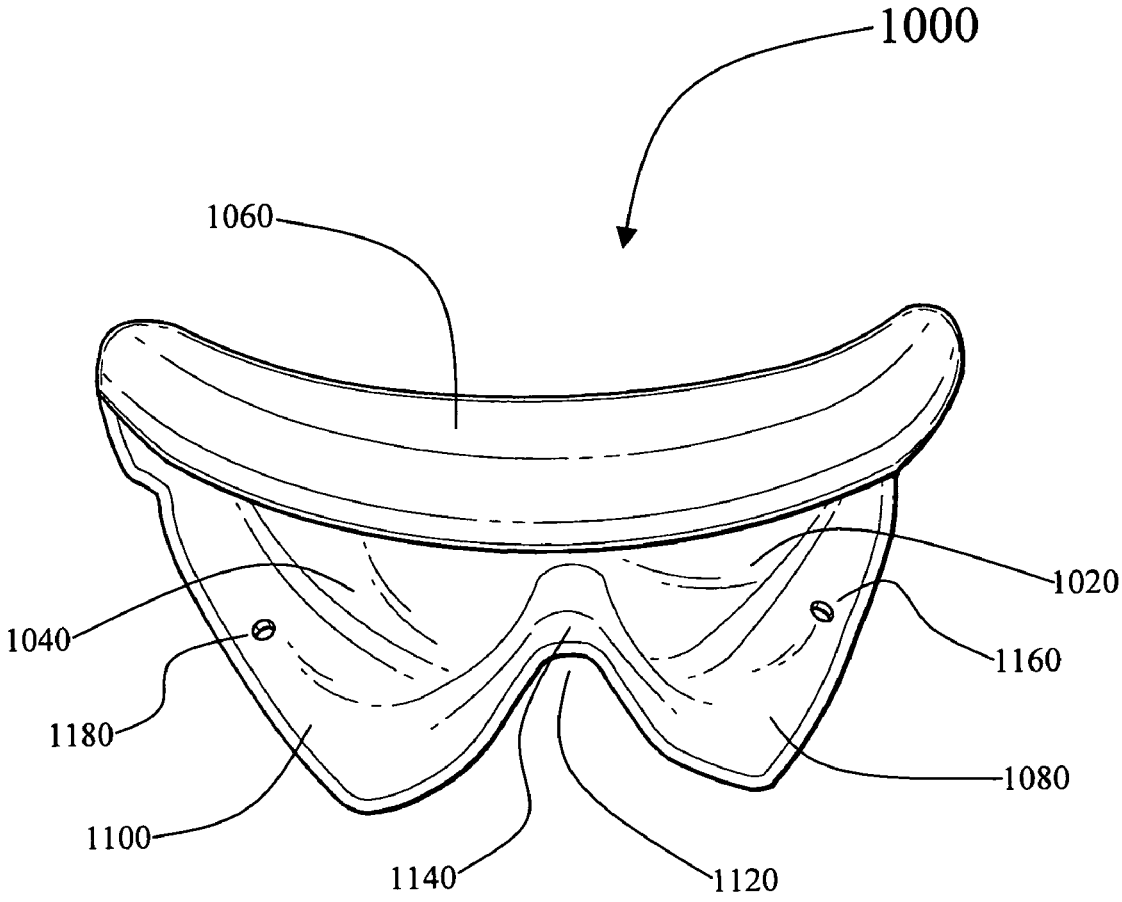
FIG. 5 shows a front perspective view of a ballistic visor according to the invention.

In more detail, and referring to FIG. 5, a front perspective view of the ballistic visor 1000 according to the invention is shown. The ballistic visor 1000 comprises a left eye shield 1020, a right eye shield 1040, and a helmet rim cover 1060. The bottom of the left and right eye shields 1020 and 1040 respectively define outward and downward facing left and right flanges 1080 and 1100, respectively. A recess 1120 is located in the middle of the ballistic visor 1000. The recess 1120 fits over nose section 220 and nose apex 440 of ballistic face guard 100. An optional outward facing recess flange 1140 fits over the nose apex 440.

Optional left and right permanent connection means 1160 and 1180, respectively, can be used to permanently or semi-permanently keep visor 1000 attached to the ballistic face guard 100 thus allowing a soldier to quickly fit combined face guard 100 and visor 1000 to helmet 140. The connection means 1160 and 1180 can be any suitable connection means such as screws, rivets, adhesive or glue such as any suitable hardener-resin adhesive system, etc.

Still referring to FIG. 5, the left and right flanges 1080 and 1100 are shaped and angled to fit substantially flush against the left and right downward sloping ledges 360 and 380, respectively. The helmet rim cover 1060 is designed to fit over the front rim 660 of helmet 140. Thus, energy from ballistic impacts on the visor 1000 is efficiently transferred to the face guard 100 and helmet system 140. The left and right flanges 1080 and 1100 are typically, but not necessarily, integral extensions of the bottom of left and right eye shields 1020 and 1040, respectively.

It should be understood that the left and right eye shields 1020 and 1040 can be manufactured to conform to optician recommended eye prescription requirements. Thus, the left and right eye shields 1020 and 1040 can offer normal sight transparent areas via which a normal sighted wearer can clearly view his/her surroundings while enjoying significant eye protection against fragment and/or bullet impacts. Alternatively, the left and right eye shields 1020 and 1040 can be individually manufactured to conform to eye lens prescription requirements determined by a competent eye optician. For example, the left eye shield 1020 can be designed for normal sight and the right eye shield 1040 manufactured to conform to a predetermined eye lens prescription. Thus, the combination of ballistic face guard 100 and visor 1000 provides high-grade protection to the wearer, regardless of their eye prescription requirements, without suffering unbearable restrictions on viewing capability.

Figure 6:
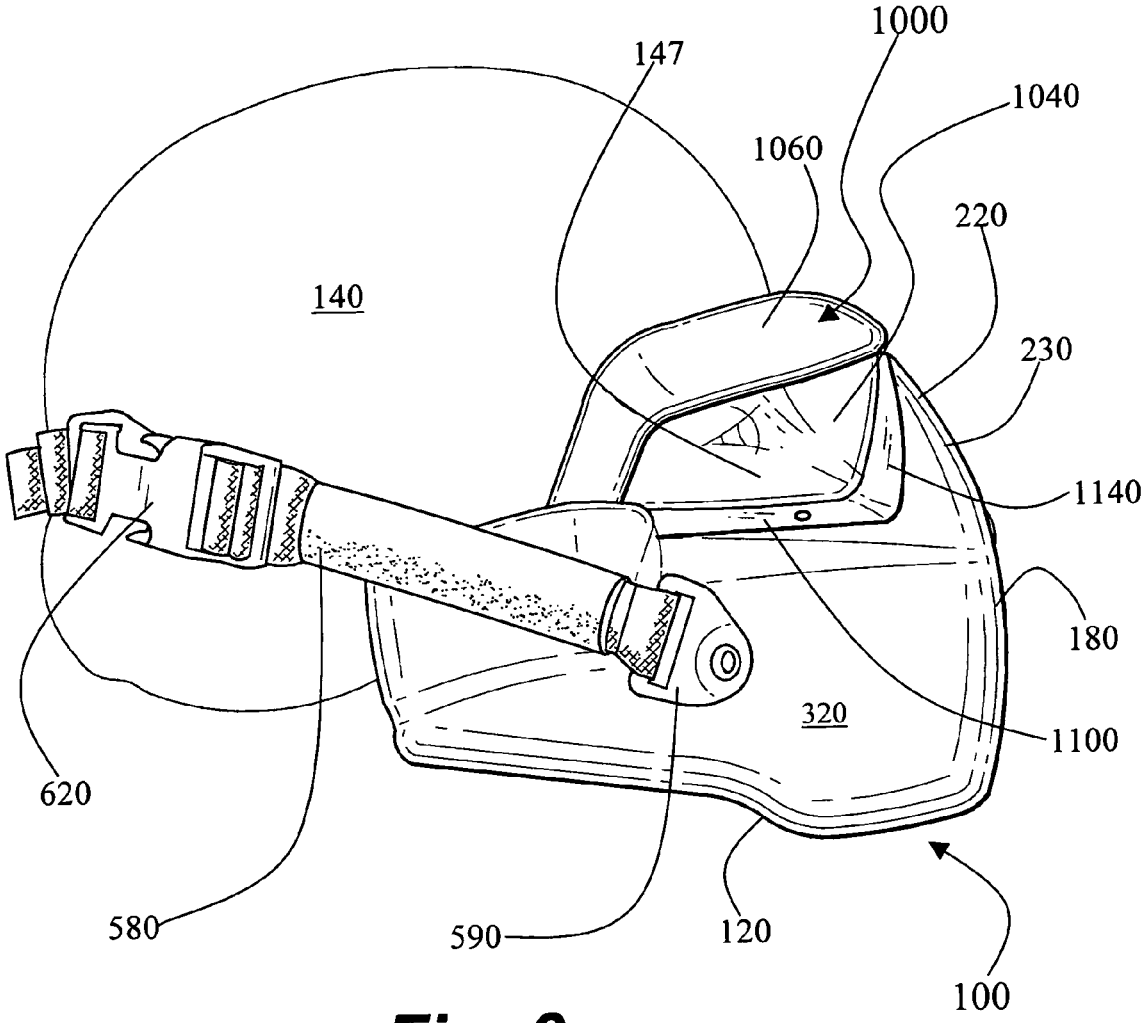
FIG. 6 shows a right side perspective view of a ballistic face guard combined with a ballistic visor, both of which are shown fitted to a helmet according to the invention.

FIG. 6 shows the visor 1000 fitted to ballistic face guard 100, both of which in turn are fitted to helmet 140 thus providing the wearer with excellent combined protection against ballistic fragments to the head, eyes, face and/or neck.

Figure 7:
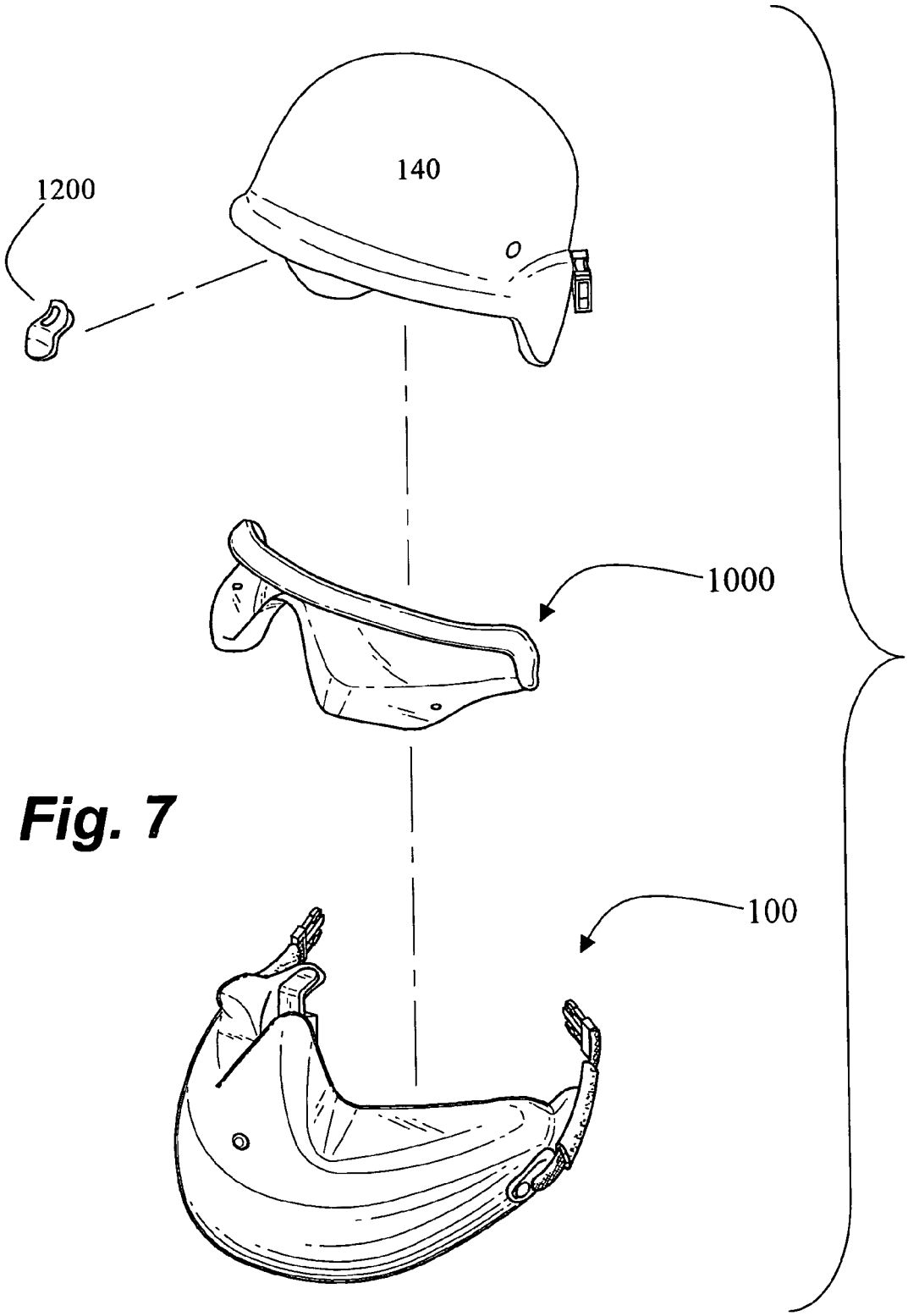
FIG. 7 shows an exploded view of the ballistic face guard, ballistic visor and helmet along with an adapter for a night vision device.

FIG. 7 shows an exploded view of the ballistic face guard, ballistic visor and helmet along with an adapter 1200 for a night vision device.

Figure 8:
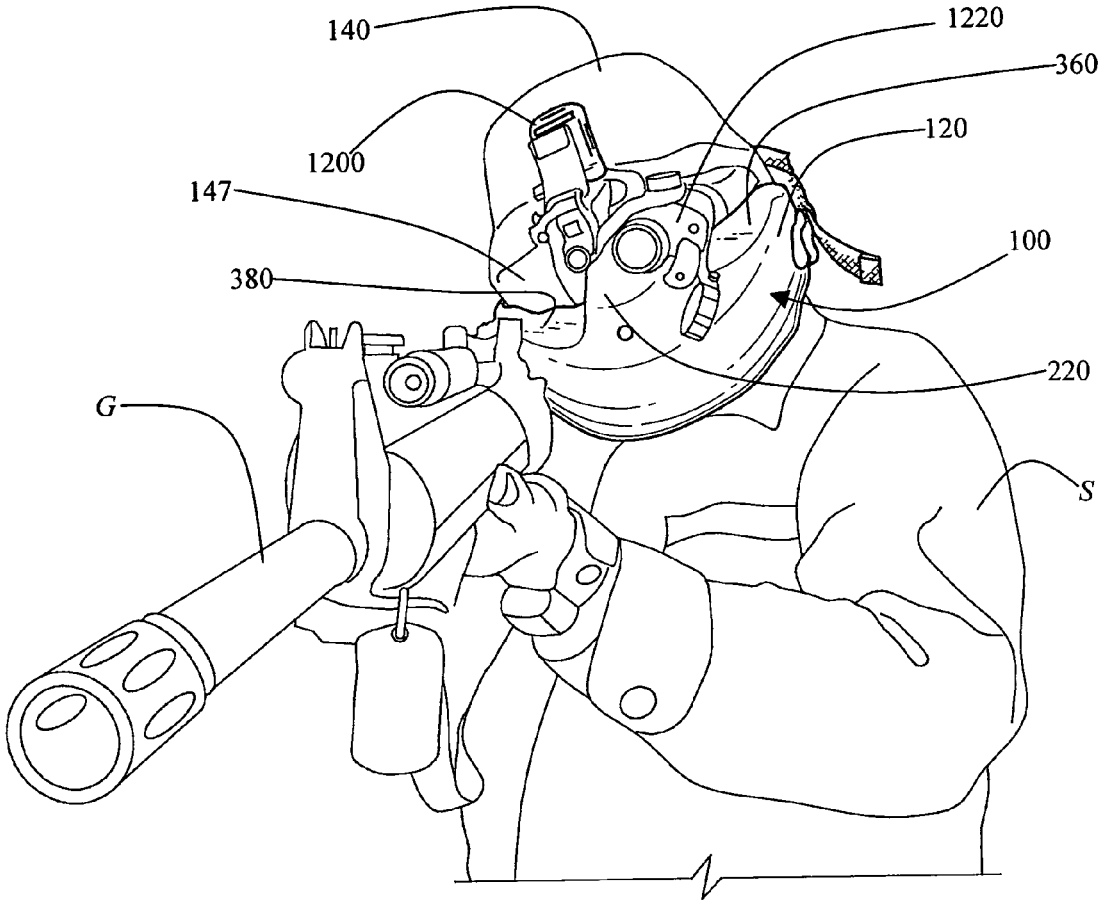
FIG. 8 shows a front environmental perspective view of a ballistic face guard according to the invention fitted with a night vision device.

FIG. 8 shows a front environmental perspective view of the ballistic face guard 100 fitted with a night vision device 1220. In more detail, a soldier S is shown sighting a gun G on a target (not shown) using the night vision device 1220 fitted to face guard 100.

FIG. 9 shows a different embodiment of ballistic visor 1000 (actually represented by alpha-numeric label "1000*a*"). The ballistic visor 1000*a* is similar to visor 1000 except that ballistic visor 1000*a* lacks left and right flanges 1080 and 1100 and lacks recess flange 1140. The ballistic visor 1000*a* has helmet rim cover 1060 and recess 1120. Energy from a ballistic fragment impacting on ballistic visor 1000*a* is transmitted to helmet 140 for the most part via helmet rim cover 1060.

Figure 10:
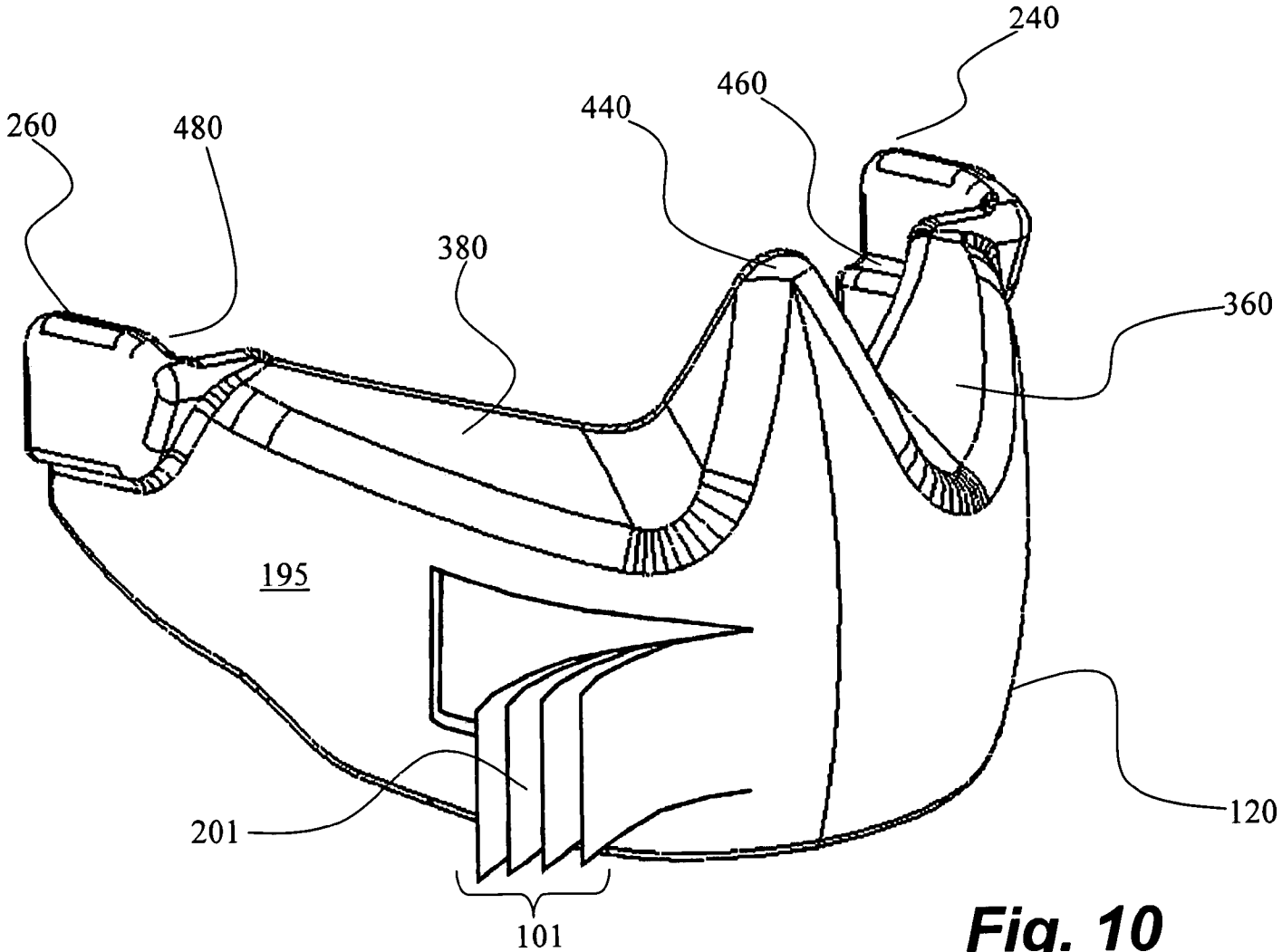
FIG. 10 shows a partially cut-away perspective view of a ballistic face guard according to the invention.

FIG. 10 shows a partially cut-away perspective view of the ballistic frame member 120, with a plurality of layers 101 partially folded back. The ballistic frame member 120, as shown, comprises a plurality of layers, which in turn comprise at least one layer of organic polymer 201, such as, but not limited to at least one layer of aramid woven fiber such as, but not limited to, at least one layer of Kevlar (DuPont). Kevlar is a registered trademark of E.I. du Pont de Nemours and Company. It should be understood that the plurality of layers 101, as shown in FIG. 10, are not drawn to scale.

The exemplary embodiments described above are meant to be illustrative, and not limiting of the scope of the invention.

I claim:

1. A ballistic face guard for protecting a wearer's face and neck, comprising:

a ballistic frame member, said frame member is curved in the horizontal plane to fit around a wearer's face, said frame member comprising: at least one layer of ballistic resistant material, left and right rear ends, a front end, a nose section, a top, a bottom, an exterior surface, and a semi-enclosed surface, wherein said exterior surface of said frame member between said front end and rear ends is substantially convex-outwardly shaped in the vertical plane, wherein said nose section has a left side and a right side, wherein the top part of said ballistic frame member is shaped to provide at least one downward facing slope proximate to the left or right side of said nose section, and wherein at least one of said left and right rear ends includes a semi-enclosed ledge; and a buckle attachment system for reversibly attaching said ballistic frame member to a helmet and wherein said nose section has an apex and a central connector attached thereto for attaching said front end of said ballistic frame member to a front rim of a helmet (140).

2. A ballistic face guard for protecting a wearer's face and neck, comprising:

a ballistic frame member, said frame member is curved in the horizontal plane to fit around a wearer's face, said frame member comprising: at least one layer of ballistic resistant material, left and right rear ends, a front end, a nose section, a top, a bottom, an exterior surface, and a semi-enclosed surface, wherein said exterior surface of said frame member between said front end and rear ends is substantially convex-outwardly shaped in the vertical plane, wherein said nose section has a left side and a right side, wherein the top part of said ballistic frame member is shaped to provide at least one downward facing slope proximate to the left or right side of said nose section, and wherein at least one of said left and right rear ends includes a semi-enclosed ledge; and a buckle attachment system for reversibly attaching said ballistic frame member to a helmet in combination with, and attached to, a helmet (140) and a ballistic visor (1000).

3. A ballistic visor (1000), comprising:

a left eye shield 1020 and a right eye shield 1040, wherein said left eye shield 1020 includes a lower left flange (1080) extending outwards at a downward angle, and wherein said right eye shield 1040 includes a right flange (1100) extending outwards at a downward angle;

a helmet rim cover (1060) located above said left (1020) and right (1040) eye shields; and a recess (1120) located between said left (1020) and right (1040) eye shields wherein said ballistic visor (1000) is attached to a ballistic face guard (100), wherein said ballistic face guard (100) comprises a left downward sloping ledge (360) and a right downward sloping ledge (380), and further wherein said left flange (1080) is shaped to fit substantially flush against said left downward sloping ledge (360), and said right flange (1100) is shaped to fit substantially flush against said right downward sloping ledge (380).

* * * * *